US005161907A

United States Patent [19]

Byrne

[11] Patent Number: 5,161,907

[45] Date of Patent: Nov. 10, 1992

[54] COMBINATION PHOTO AND VIDEO CASSETTE ALBUM

[76] Inventor: Charles T. Byrne, P.O. Box 2436, Corona, Calif. 91718

[21] Appl. No.: 786,396

[22] Filed: Nov. 1, 1991

[51] Int. Cl.[5] ..... B42F 13/40; B65D 85/672

[52] U.S. Cl. ..... 402/4; 40/159; 206/387; 206/455; 206/472; 281/31; 402/79

[58] Field of Search ..... 206/387, 455, 449, 472; 402/79, 80 R, 4; 281/31; 40/159

[56] References Cited

U.S. PATENT DOCUMENTS

| | | | |
|---|---|---|---|
| 3,829,132 | 8/1974 | Willieme | 281/31 |
| 3,866,751 | 2/1975 | Holert | 206/387 |
| 4,002,355 | 1/1977 | Sendor | 206/387 X |
| 4,049,119 | 9/1977 | Wilson | 206/387 |
| 4,255,872 | 3/1981 | Williams, Sr. | 206/387 X |
| 4,290,524 | 9/1981 | Azar | 206/387 X |
| 4,306,737 | 12/1981 | Emchiello | 206/472 X |
| 4,588,321 | 5/1986 | Egly | 206/473 X |
| 4,828,105 | 5/1989 | Silengo et al. | 206/387 X |
| 4,965,948 | 10/1990 | Ruebens | 402/79 X |
| 5,066,158 | 11/1991 | Huang | 402/4 |

FOREIGN PATENT DOCUMENTS

| | | | |
|---|---|---|---|
| 2749854 | 5/1979 | Fed. Rep. of Germany | 281/31 |
| 2543516 | 10/1984 | France | 206/387 |
| 890131 | 2/1962 | United Kingdom | 281/31 |

*Primary Examiner*—Bryon P. Gehman
*Attorney, Agent, or Firm*—James G. O'Neill

[57] ABSTRACT

A combination photo/video cassette album having loose leaf pages for holding photographs removably held between front and back covers. Some of the pages are reduced in size to enable a video cassette holder to be fixed to the interior of one of the covers of the album and held in place adjacent to such partial pages, so that the partial pages are nested next to the video cassette holder, and a video cassette held therein, when the covers of the album are in the closed position.

8 Claims, 2 Drawing Sheets

COMBINATION PHOTO AND VIDEO CASSETTE ALBUM

BACKGROUND OF THE INVENTION

1. Field of the Invention

This invention relates generally to photo albums and more particularly to an improved combination photo/video cassette album.

2. Description of Related Art

With the advent of readily useable and relatively inexpensive camcorders to make videos of special occasions, and video recording devices to play these and other video recordings in the privacy of one's home, there exists the need for a single album or storage means for holding both still photographs and related video cassettes that a person wishes to retain and store together, for easy access and to prevent their loss and/or separation.

While books and other means for holding cassettes or films are known, they take the form of specifically designed storage containers having bound or insertable pages, as well as a recess formed in or insertable within the storage container for holding audio cassettes, books, or magnetic disks for specific purposes. However, after many attempts to solve the problems of storing still photographs and video cassettes of related events, in a cheap, easy to use and convenient manner, there still exists the need for a single storage means for photos and related video cassettes that meets all of the above criteria.

One such prior art storage means is disclosed in U.S. Pat. No. 3,866,751 which shows a book having a pair of covers with pages bound therein and an opening along one edge or the front cover of the book, into which an audio cassette may be inserted for storage or withdrawn for use. This patent, however fails to show the combination of a loose leaf photo album and video cassette holder of the type disclosed herein.

U.S. Pat. Nos. 2,341,600, 3,583,729, 4,002,355, 4,049,119, 4,588,321, 4,765,466 and 4,828,105 all show various other storage containers for holding a roll of film, an audio tape, a magnetic disk, or similar articles, together with bound or unbound pages, for specific purposes, as recited in each of these patents. None of these patents, whether taken alone or in combination, show the specific combination of a loose leaf photo album and video cassette holder of the type disclosed in the present specification.

U.S. Pat. Nos. 3,829,132 and 4,290,524 show still further storage containers for holding video cassettes with specific cover means to hold a cassette and a book or pages therein, or for shipment and storage of a video cassette having a series of indexable video programs and a related magazine or program which includes program guides corresponding to each program in the series of indexable video programs on the video cassette. Again, these patents, whether taken alone or in combination, fail to show the specific combination of a loose leaf photo album and video cassette holder of the type disclosed in the present specification.

SUMMARY OF THE INVENTION

Accordingly, it is a general object of the present invention to provide a combination album for the storage of still photographs and video cassettes. It is a particular object of the present invention to provide a storage means in which related photographs and a video cassette may be conveniently held. And, it is a further object of the present invention to provide a single album having both full and partial, insertable pages for photographs, and a holder for the storage of a related video cassette within the album, capable of being nested next to the partial pages when the album is closed.

In accordance with one aspect of the invention there is provided an album of the loose leaf or multi-ring notebook type having a front and back cover and a plurality of insertable pages therein for holding photographs. Some of the pages are reduced in size to enable a video cassette holder to be fixed to the interior of one of the covers of the album and held in place adjacent to such partial pages, so that the partial pages are in a nested relationship beside the video cassette holder and a video cassette held therein, when the covers of the album are in the closed position.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

Figure 1:
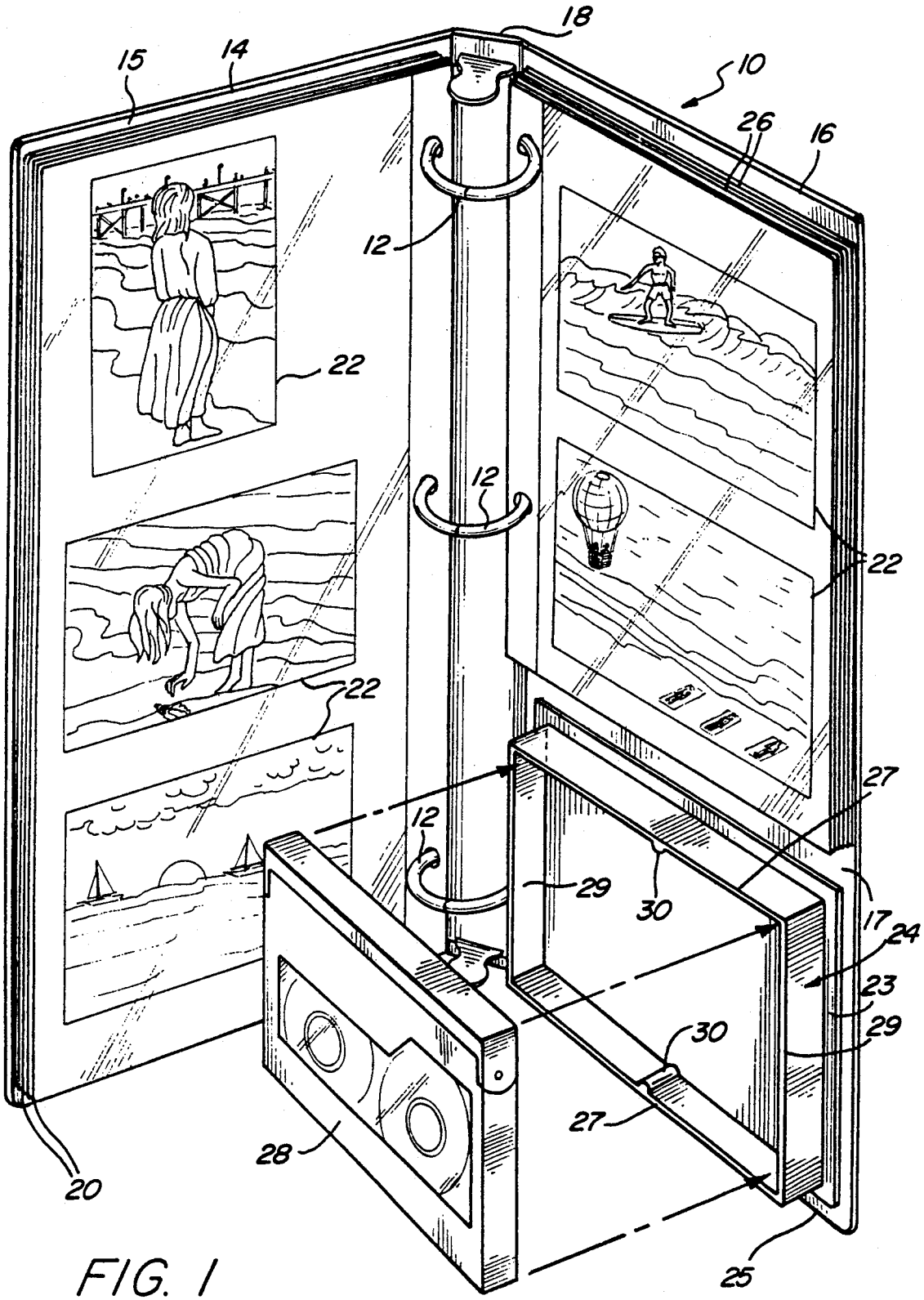
FIG. 1 is a perspective view of a combination album in accordance with the present invention, with the album covers in the open position and showing a video cassette that may be inserted in and held in a cassette holder fixed within the album.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for the description of an improved combination photo/video cassette album, generally indicated at 10. The album 10 is shown as being of the three ring binder type for purposes of illustration only. It is to be understood that any loose leaf binder or similar type album having three or more rings may be used, so long as the album includes all the elements of, performs as, and may be utilized in accordance with, the description set forth herein.

As indicated, the album has three or more rings 12, mounted or fixed between a pair of stiff, substantially rectangular front and rear covers 14, 16, having interior surfaces 15, 17, along the interior surface of a connecting spine 18, in a manner known to those skilled in the art. The rings of the album are opened and closed in a known manner, to enable a plurality of substantially rectangular pages or holders, such as full pages 20 to be inserted in and removed from the rings. The insertable full pages 20 may be of any known type for holding still photographs 22 therein or thereon, and are only slightly smaller in size than the covers 14, 16.

Figure 2:
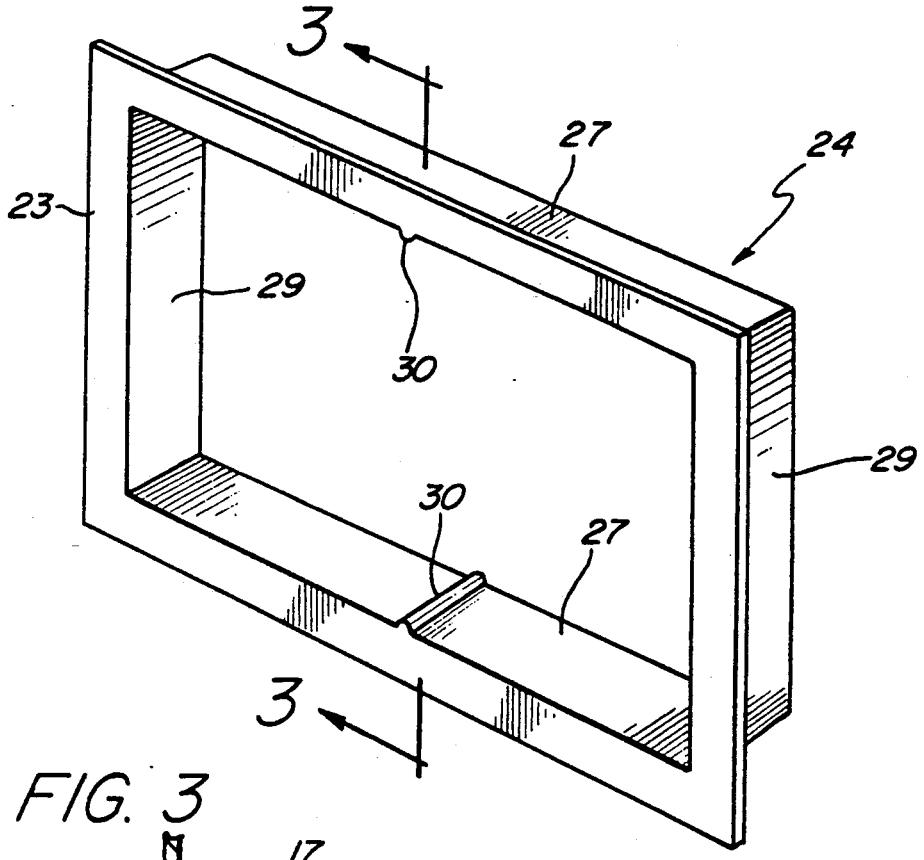
FIG. 2 is a perspective view of one embodiment of the cassette holder of FIG. 1, removed from the inside cover of the album.
Figure 3:
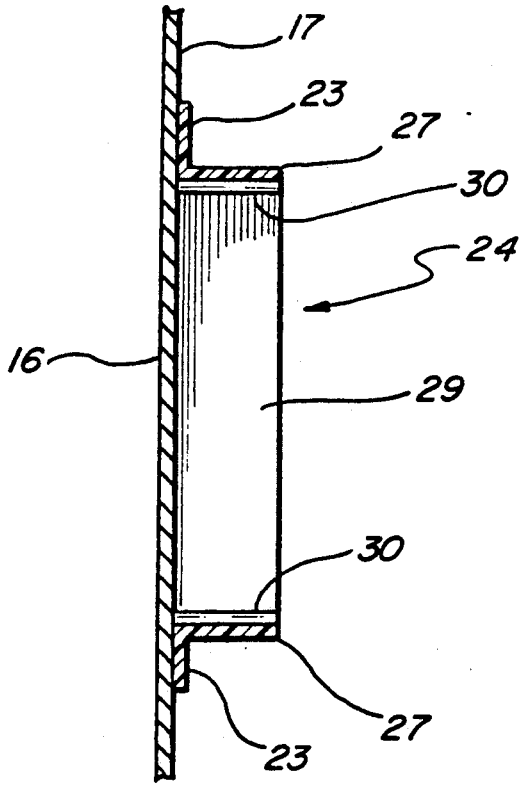
FIG. 3 is a cross-sectional view taken along line 3—3 of FIG. 2.

As shown in FIG. 1, the interior surface 17 of rear cover 16 has a substantially rectangular cassette holder 24, permanently fixed or secured thereto in any convenient manner, as by adhesive. The holder 24 is preferably connected to a surrounding lip 23, fixed to, or formed integrally with and completely surrounding the holder 24. The lip 23 is in turn secured to the interior surface 17. The cassette holder 24 may include a base to fully enclose a central opening receiving a video cassette 28, or, as shown more clearly in FIGS. 2 & 3, may be constructed as a hollow, rectangular rim surrounding the central opening. The holder 24 is shown as being secured by the lip 23 along the lower portion of the interior surface 17 of the rectangular back or rear cover 16, with long axis or longer edges 27 thereof parallel to a bottom or lower edge 25 of the rear cover. A plurality of partial or reduced size substantially rectangular pages 26 are shown as being inserted in and held on the top two rings 12. These partial pages extend to just above the holder 24, and are substantially smaller in size than the full pages 20 and the covers 14, 16, but are still of a size so they may hold photographs 22. That is, the partial pages 26 are sized so as to both receive photographs and allow the holder 24 to be nested next to the partial pages when the covers of the album 10 are closed. Therefore, when the covers 14, 16 of the album 10 are closed, there will be no obstructions or areas against which the holder 24 or any cassette 28 held therein will abut or hang up, thereby allowing the album covers to be fully closed, in a manner typical to known photo albums, so that the closed album 10 presents the same profile, in the fully closed position, as known photo albums, which do not carry video cassettes.

It should be obvious to those skilled in the art that the holder 24 may be fixed to the interior surface of either the front or rear cover, in any desired position where it is both close to and parallel to the bottom, side or top edge of the covers, so long as substantially rectangular partial pages may be adapted to be inserted in the album 10 and held therein, in a nested relationship next to the holder and a video cassette, when the covers of the album are closed.

The video cassette 28, may be of any known size, such as VHS, VHS-SUPER 8, or BETA, and the size of the holder 24 held in the album 10 is easily changed, according to the size of the video cassette it is desired to hold within the album. The video cassette is inserted in and frictionally held in the holder 24 by securing means, such as a pair of resilient beads or fingers 30, formed integrally with or secured interiorly of the side edges 27 of the holder. With the video cassette 28 completely inserted in the central opening of holder 24, the beads 30 resiliently grip the video cassette and hold it in place. The height of the side edges 27 and 29 of the holder 24 are preferably selected so that the cassette held within the holder will not stick out from, or extend above the top surface of these side edges. In addition, if desired or needed, further securing means, such as a strap or the like may be included on the holder. For example, a strap may be fixed to one or more of the side edges of holder 24 and then passed over the cassette for fixation to one or more of the other side edges, to thereby act against and more securely hold the video cassette 28 in position within the holder 24.

It, therefore, can be seen that the album of the present invention provides a simplified, easy to use and inexpensive means for conveniently storing related still photographs and video cassettes. The album, with both the photos and the video cassette therein, may be closed and placed on a book shelf or the like, together with other albums and books, without detracting from the appearance of the room in which it is placed. The album of the present invention allows both still photographs and video cassettes of special events or moments to be kept together, for easy access when it is desired to view them. By keeping these items together, there will be no need for a long, tedious and sometimes unrewarding search through the separately stored photographs and video cassettes that are normally found scattered throughout the usual household.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A combination still photograph and video cassette storage album, comprising, in combination:

a substantially rectangular album having a substantially rectangular, flat front cover and a substantially rectangular, flat rear cover connected by an elongated spine, with said front and rear covers movable between open and closed positions;

said front and rear covers and said spine having upper and lower edges and exterior and interior surfaces;

a plurality of releasable rings fixed to the interior surface of said spine between the interior surfaces of said front and rear covers;

a plurality of substantially rectangular pages releasably held by said releasable rings within said album between said interior surfaces of said front and rear covers;

said pages being adapted to hold still photographs on or therein with some of the pages being full pages that are slightly smaller in size than said front and rear covers, and some of the said pages being partial pages that are substantially smaller in size than said full pages; and a substantially rectangular video cassette holder having four raised side edges, two of which raised side edges are long and two of which raised side edges are short; said raised side edged adapted to receive and hold a video cassette in a central open area formed therein by said raised side edges; said substantially rectangular holder being permanently secured to the interior surface of one of said front and rear covers with said raised side edges of said substantially rectangular holder parallel to said edges of said rectangular cover to which it is secured and adjacent to said partial pages, whereby said partial pages and said substantially rectangular holder are nested next to each other when said front cover and said rear cover of said album are in said closed position.

2. The combination still photograph and video cassette storage album of claim 1 wherein said substantially rectangular holder is secured to said interior surface of said rear cover.

3. The combination still photograph and video cassette storage album of claim 2 wherein said substantially rectangular holder is secured to said rear cover with said two raised long side edges thereof parallel and adjacent to said lower edge of said rear cover, sand said partial pages are held in said album above said substantially rectangular holder in the direction away from said lower edge of said rear cover.

4. The combination still photograph and video cassette storage album of claim 3 wherein there are at least three releasable rings, adapted to releasably hold said plurality of pages in said album by means of holes formed in said plurality of pages.

5. The combination still photograph and video cassette storage album of claim 1 wherein said substantially rectangular holder is secured to said interior surface of said front cover.

6. The combination still photograph and video cassette storage album of claim 5 wherein said substantially rectangular holder is secured to said interior surface of said front cover with said two raised long side edges thereof parallel and adjacent to said lower edge of said front cover, and said partial pages are held in said album above said substantially rectangular holder in the direction away from said lower edge of said front cover.

7. The combination still photograph and video cassette storage album of claim 6 wherein there are at least three releasable rings, adapted to releasably hold said plurality of page in said album by means of holes formed in said plurality of pages.

8. A combinations till photograph and video cassette storage album, comprising, in combination:

a substantially rectangular album having a substantially rectangular, flat front cover and a substantially rectangular, flat rear cover connected together along side edges by an elongated spine, with said front and rear covers movable between open and closed positions;

said front cover, said rear cover and said spine having upper and lower edges and exterior and interior surfaces;

a plurality of releasable rings fixed to the interior surface of said spine between the interior surfaces of said covers;

a plurality of substantially rectangular pages having holes therein adapted to be releasably held by said releasable rings within said album between said interior surfaces of said front cover and said rear cover;

said pages being adapted to hold still photographs on or therein, with some of said pages being full page that are slightly smaller in size than said front cover and said rear cover, and some of said pages being partial pages that are substantially smaller in size than said full pages; and a substantially rectangular holder having four raised side edges forming a substantially rectangular interior opening, two of which raised side edges are longer and two of which raised side edges are shorter; said substantially rectangular holder permanently secured to the interior surface of said rear cover with said two raised longer side edges parallel to said lower edge of said rear cover and adjacent to said partial pages, with the partial pages held in said rings in said album above said substantially rectangular holder in the direction away from said lower edge of said rear cover; said substantially rectangular holder including a resilient bead formed on an interior surface of each of said raised longer side edges, to thereby receive and hold a video cassette in said substantially rectangular interior opening in said substantially rectangular holder by said resilient beads, whereby said partial pages and said substantially rectangular holder, with said video cassette therein, are nested next to each other when said front cover and said rear cover of said album are in said closed position.

* * * * *